US009285709B2

(12) United States Patent
Sasaki et al.

(10) Patent No.: US 9,285,709 B2
(45) Date of Patent: Mar. 15, 2016

(54) DEVELOPING DEVICE PROVIDED WITH TONER CONCENTRATION DETECTION SECTION AND IMAGE FORMING APPARATUS PROVIDED WITH SAME

(71) Applicant: KYOCERA Document Solutions Inc., Osaka (JP)

(72) Inventors: Yu Sasaki, Osaka (JP); Yoshinobu Yoneima, Osaka (JP)

(73) Assignee: KYOCERA Document Solutions Inc., Tamatsukuri, Chuo-ku, Osaka (JP)

( * ) Notice: Subject to any disclaimer, the term of this patent is extended or adjusted under 35 U.S.C. 154(b) by 0 days.

(21) Appl. No.: 14/812,168

(22) Filed: Jul. 29, 2015

(65) Prior Publication Data

US 2016/0041503 A1 Feb. 11, 2016

(30) Foreign Application Priority Data

Aug. 8, 2014 (JP) ..... 2014-162477

(51) Int. Cl.
*G03G 15/08* (2006.01)

(52) U.S. Cl.
CPC ..... *G03G 15/0889* (2013.01); *G03G 15/0824* (2013.01); *G03G 15/0849* (2013.01)

(58) Field of Classification Search
CPC ..... G03G 15/0889; G03G 15/0824; G03G 15/0849; G03G 15/0853; G03G 2215/0822; G03G 2215/085
USPC ..... 399/62–64, 99, 254, 256
See application file for complete search history.

(56) References Cited

U.S. PATENT DOCUMENTS

| | | | | | |
|---|---|---|---|---|---|
| 4,963,929 | A * | 10/1990 | Ueda | G03G 15/0853 | 118/691 |
| 5,649,264 | A * | 7/1997 | Domon | G03G 15/0896 | 399/27 |
| 8,145,100 | B2 * | 3/2012 | Hirayama | G03G 15/0853 | 399/256 |
| 8,995,851 | B2 * | 3/2015 | Ikebata | G03G 15/0824 | 399/27 |
| 2012/0177412 | A1 * | 7/2012 | Watanabe | G03G 15/0189 | 399/256 |
| 2014/0086599 | A1 * | 3/2014 | Gofuku | G03G 21/00 | 399/27 |

FOREIGN PATENT DOCUMENTS

| | | | |
|---|---|---|---|
| JP | H05-150650 | A | 6/1993 |
| JP | 2003-287948 | A * | 10/2003 |
| JP | 2009-122202 | A * | 6/2009 |
| JP | 2012-168232 | A * | 9/2012 |

* cited by examiner

*Primary Examiner* — Robert Beatty

(57) ABSTRACT

A developing device includes: a container, a stirring member, a developing roller, a toner concentration detection section, a stirring plate, and an elastic member. The stirring plate is attached to the rotary shaft of the stirring member in a manner such as to be rotatable together with the rotary shaft, and has a tip part located in the radial direction at a predefined distance from the detection surface. The elastic member has elasticity, is attached to the stirring plate in a manner such as to surround a one-side surface, an another-side surface, and the tip part in a rotation direction of the stirring plate, has a sufficient length in the radial direction enough to abut the detection surface, and makes sliding-contact with the detection surface while rotating together with the stirring plate.

3 Claims, 8 Drawing Sheets

DEVELOPING DEVICE PROVIDED WITH TONER CONCENTRATION DETECTION SECTION AND IMAGE FORMING APPARATUS PROVIDED WITH SAME

INCORPORATION BY REFERENCE

This application claims priority to Japanese Patent Application No. 2014-162477 filed on Aug. 8, 2014, the entire contents of which are incorporated by reference herein

BACKGROUND

This disclosure relate to an image forming apparatus using an electrophotographic system in particular, such as a copier, a printer, a facsimile, or a multifunction peripheral combining them together and a developing device of such an image forming apparatus, and to a technology of detecting concentration of a toner used in the developing device.

In the image forming apparatus such as the multifunction peripheral, a developing device is provided to attach a toner to an electrostatic latent image formed on a surface of a photoconductive drum to develop the electrostatic latent image. For example, as developer used in the developing device, binary-type developer composed of a toner and magnetic carriers is widely used. In such a device, a blend ratio between the toner and the carriers (toner concentration) is a significant factor in terms of effects of development. That is, when the toner concentration becomes equal to or less than an appropriate value, image concentration decreases, and when the toner concentration becomes equal to or more than the appropriate value, a problem such as so-called fogging occurs.

Therefore, to obtain a favorable image by the image forming apparatus, it is required to accurately detect the toner concentration and control the toner concentration at the appropriate value. As configuration for the toner concentration detection, for example, a magnetic detector detecting a change in magnetic permeability in developer or an optical detector detecting reflective light of developer is used. The concentration detector normally has a detection surface of a detection section on an inner surface of a container having a toner refill port, but toner adherence to the detection surface of the detection section results in failure to perform accurate detection, causing an error.

Thus, a developing device has already been suggested which having a blade provided on an inner surface of the container to clean the detection surface. In this device, a stirring plate is fixed to a stirring member which stirs developer while making rotation, and this stirring plate is arranged at a position opposing a detection surface of a toner concentration sensor. Fixed on a one-side surface of this stirring plate is a flexible blade. A length of the blade is set at a length which permits a tip of the blade to reach the detection surface. In this device, deflection of the blade is utilized to perform cleaning of the detection surface.

SUMMARY

As one aspect of this disclosure, a technology obtained by further improving the technology described above will be suggested.

A developing device according to one aspect of this disclosure includes: a container, a stirring member, a developing roller, a toner concentration detection section, a stirring plate, and an elastic member.

The container stores developer.

The stirring member stirs the developer stored in the container while making rotation.

The developing roller supplies the developer to a photoconductor.

The toner concentration detection section has a detection surface exposed inside of the container and detects concentration of a toner in the container.

The stirring plate extends in a direction along a rotary shaft of the stirring member and a radial direction orthogonal to the direction along the rotary shaft, and is attached to the rotary shaft of the stirring member in a manner such as to be rotatable together with the rotary shaft, and has a tip part located in the radial direction at a predefined distance from the detection surface.

The elastic member has elasticity, and is attached to the stirring plate in a manner such as to surround a one-side surface, an another-side surface, and the tip part in a rotation direction of the stirring plate, and has a sufficient length in the radial direction enough to abut the detection surface, and makes sliding-contact with the detection surface while rotating together with the stirring plate.

An image forming apparatus according to another aspect of this disclosure includes: the developing device described above, a rotational driving section, and a control section.

The rotational driving section drives the stirring member and the stirring plate into rotation.

The control section drives the rotational driving section to rotate the stirring member and the stirring plate.

DETAILED DESCRIPTION

Hereinafter, a developing device and an image forming apparatus according to embodiments as one aspect of this disclosure will be described with reference to the drawings.

Figure 1:
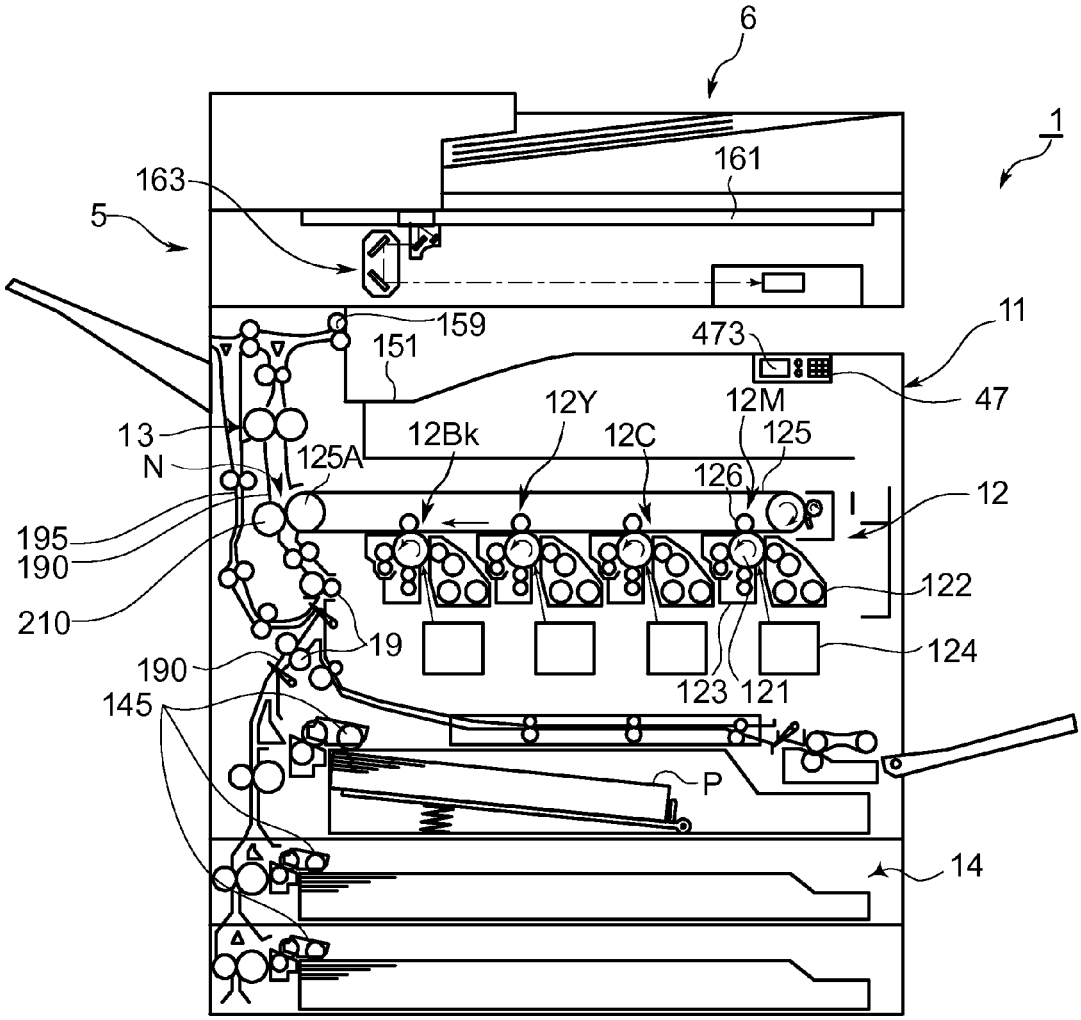
FIG. 1 is an elevation sectional view showing a structure of an image forming apparatus according to a first embodiment of this disclosure.

FIG. 1 is an elevation sectional view showing the image forming apparatus according to the first embodiment of this disclosure. The image forming apparatus 1 according to the first embodiment of this disclosure is, for example, a multifunction peripheral combining a plurality of functions such as a copy function, a printer function, a scanner function, and a facsimile function. The image forming apparatus 1 includes:

an apparatus body 11, an operation section 47, an image formation section 12, a fixing section 13, a paper feed section 14, an original copy feed section 6, and an original copy reading section 5, etc., The operation section 47 receives, from an operator, instructions, such as an image formation operation execution instruction and an original copy reading operation execution instruction, for various operations and processing executable by the image forming apparatus 1. The operation section 47 includes a display section 473 displaying, for example, an operation guide to the operator.

In performing the original copy reading operation by the image forming apparatus 1, the original copy reading section 5 optically reads an image of an original copy fed by the original copy feed section 6 or an original copy loaded on original copy loading glass 161 to generate image data. The image data generated by the original copy reading section 5 is saved into, for example, a built-in HDD or a network-connected computer.

In performing the image formation operation by the image forming apparatus 1, based on, for example, the image data generated through the original copy reading operation, the image data received from the network-connected computer, or the image data stored in the built-in HDD, the image formation section 12 forms a toner image on paper P as a recording medium fed from the paper feed section 14.

A magenta image formation unit 12M, a cyan image formation unit 12C, a yellow image formation unit 12Y, and a black image formation unit 12Bk of the image formation section 12 each include: a photoconductive drum 121, a developing device 122, a charging device 123, a exposure device 124, and a primary transfer roller 126.

In performing color printing, the magenta image formation unit 12M, the cyan image formation unit 12C, the yellow image formation unit 12Y, and the black image formation unit 12Bk of the image formation section 12, based on the image of respective color components forming the image data, respectively form toner images onto the photoconductive drums 121 through charging, exposure, and developing processes, and transfer the toner images onto an intermediate transfer belt 125 by the primary transfer rollers 126.

The toner images of the different colors transferred on the intermediate transfer belt 125 are superimposed on each other on the intermediate transfer belt 125 through transfer timing adjustment, turning into a color toner image. A secondary transfer roller 210, at a nip part N formed with a driving roller 125A with the intermediate transfer belt 125 in between, transfers the color toner image, which has been formed on a surface of the intermediate transfer belt 125, onto the paper P conveyed from the paper feed section 14 through a conveyance path 190. Then the fixing section 13 fixes, onto the paper P, the toner image on the paper P through thermocompression. The paper P on which the color image has already been formed and then subjected to the fixing processing is discharged onto a discharge tray 151.

The paper feed section 14 includes a plurality of paper feed cassettes. A control section 100 (FIG. 4) drives, into rotation, a pick up roller 145 of the paper feed cassette storing the recording paper of a size specified by an instruction of the operator, and conveys the paper P stored in the paper feed cassette towards the nip part N.

To perform double-sided printing in the image forming apparatus 1, the paper P on one side of which the image has been formed by the image formation section 12 is nipped by a discharge roller pair 159, and then is switched back by the discharge roller pair 159 and sent to an inverted conveyance path 195, and is conveyed again by a conveyance roller pair 19 to an upstream region in a conveyance direction of the paper P with respect to the nip part N and the fixing section 13. As a result, an image is formed on another surface of the paper P by the image formation section 12.

Figure 2:
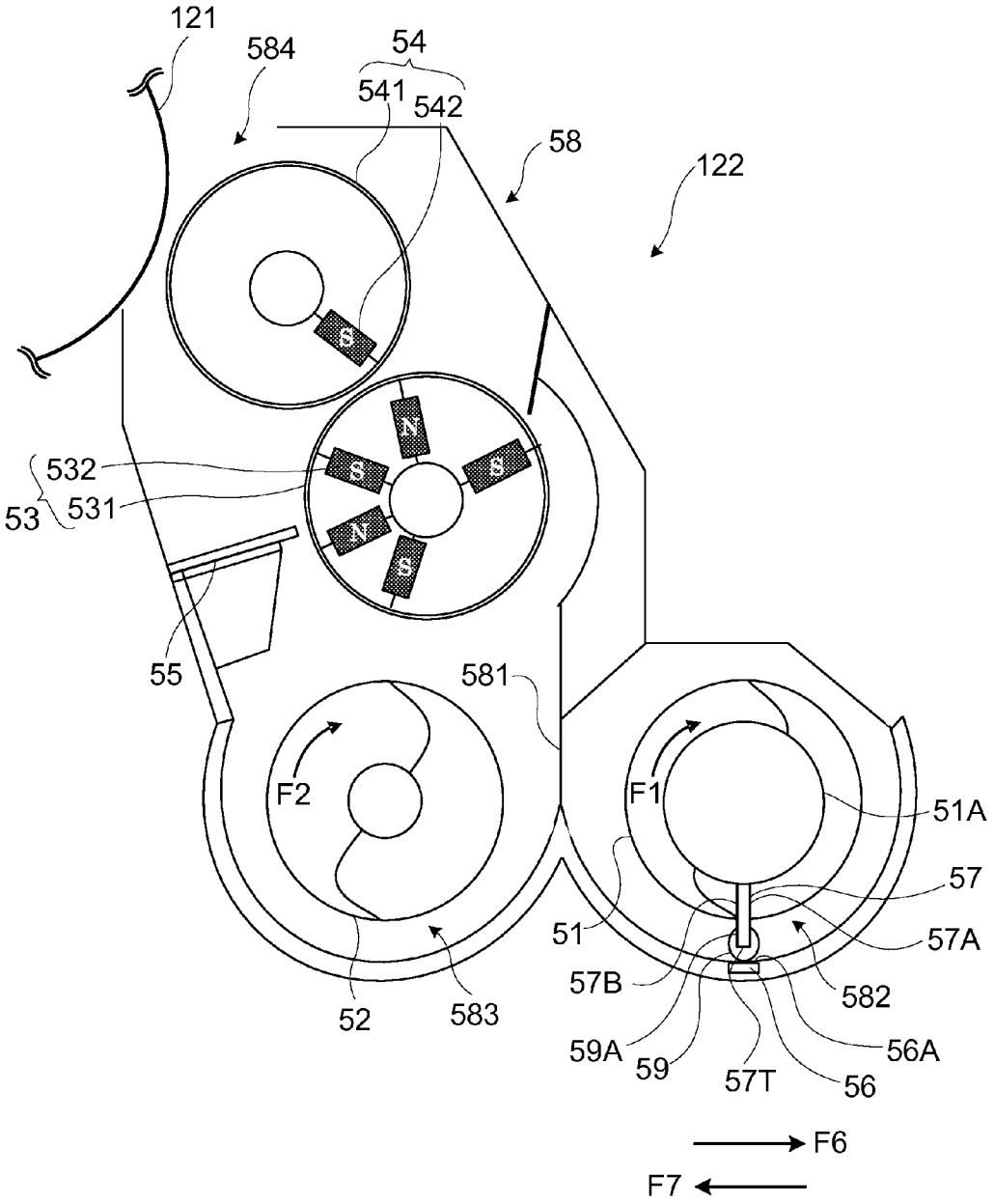
FIG. 2 is a sectional view showing a structure of a developing device according to the first embodiment of this disclosure.
Figure 3:
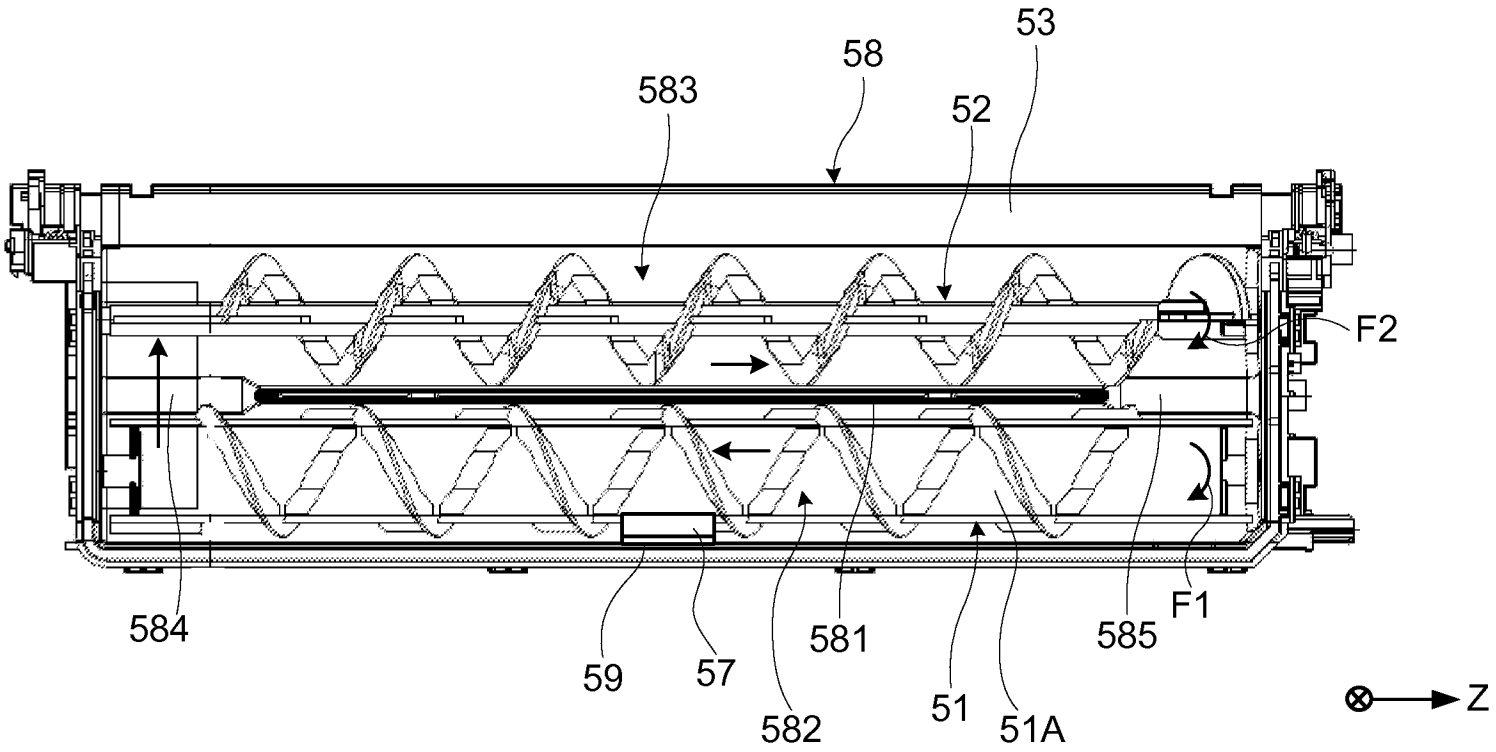
FIG. 3 is a plan view showing a structure of the developing device according to the first embodiment of this disclosure.

FIG. 2 is a sectional view showing a structure of the developing device 122 according to the first embodiment of this disclosure. FIG. 3 is a plan view showing the structure of the developing device 122 according to the first embodiment of this disclosure.

As shown in FIGS. 2 and 3, the developing device 122 includes in a housing 58: a first spiral feeder 51, a second spiral feeder 52, a supply roller 53, a developing roller 54, a regulating blade 55, a toner concentration detection section 56, a stirring plate 57, and an elastic member 59.

The housing 58 plays a role as a container storing toner-containing developer. In this embodiment, stored in the housing 58 is monocomponent developer containing a magnetic toner. The housing 58 is one example of a container in the scope of the claims.

As shown in FIG. 3, formed inside the housing 58 is a partition plate 581. As a result, the inside of the housing 58 is partitioned into: a first chamber 582 where the first spiral feeder 51 is arranged; and a second chamber 583 where the second spiral feeder 52 is arranged. The first spiral feeder 51 is one example of a stirring member in the scope of the claims. Provided at both end parts lengthwise (in a Z-direction) of the partition plate 581 are a first communication port 584 and a second communication port 585, by which the first chamber 582 and the second chamber 583 are communicated with each other.

As shown in FIG. 3, the first chamber 582 has a developer refill port (not shown) provided as an opening. Also in the first chamber 582, the first spiral feeder 51 is rotationally pivoted. The first spiral feeder 51 is driven by a roller driving section 72, to be described later on (see FIG. 4), in a direction of an arrow F1. As a result, developer refilled in the first chamber 582 is stirred and conveyed in the Z-direction. The developer conveyed in the Z-direction moves to the second chamber 583 through the first communication port 584.

As shown in FIG. 3, in the second chamber 583, the second spiral feeder 52 is rotationally pivoted. The second spiral feeder 52 is driven by the roller driving section 72 into rotation in a direction of an arrow F2. As a result, the developer stored in the second chamber 583 is conveyed in the Z-direction. The developer conveyed in the Z-direction moves to the first chamber 582 through the second communication port 585. The first spiral feeder 51 and the second spiral feeder 52 are set in a manner such that the direction in which the developer in the first chamber 582 is conveyed and the direction in which the developer in the second chamber 583 is conveyed become opposite to each other. As a result, the developer is cyclically conveyed between the first chamber 582 and the second chamber 583.

As shown in FIG. 2, the supply roller 53 includes: a sleeve 531 of a non-magnetic material; and a stationary magnet 532 having a plurality of magnetic poles (five poles in this embodiment) provided inside the sleeve 531, and plays a role of supplying the developer to the developing roller 54. The supply roller 53 is rotationally pivoted in the housing 58, and draws the developer conveyed by the first spiral feeder 51 and the second spiral feeder 52 by a magnetic force of the stationary magnet 532.

The developing roller 54 includes: a sleeve 541 of a non-magnetic material; and a stationary magnet 542 having a magnetic pole (S-pole in this embodiment) provided inside the sleeve 541, and is rotationally pivoted in the housing 58 in a manner such that it is partially exposed to an opening part 584 of the housing 58. In this state, the developing roller 54 opposes the supply roller 53 and the photoconductive drum 121.

By a magnetic field formed between the stationary magnet with the S-pole of the developing roller 54 and the stationary magnet with the N-pole of the supply roller 53, the toner carried on a circumferential surface of the supply roller 53 moves to a circumferential surface of the developing roller 54. Then the toner moved to the circumferential surface of the developing roller 54 is attracted by an electrostatic latent image formed on a circumferential surface of the photoconductive drum 121 and moves towards the circumferential surface of the photoconductive drum 121.

The regulating blade 55 regulates the developer carried on the circumferential surface of the supply roller 53 into a predefined layer thickness, and is supported in the housing 58 at a predefined interval from the developing roller 54.

For the purpose of preventing an image problem caused by shifting of the developer, which has been cumulated at the regulating blade 55, to the supply roller 53 at time of image formation and suppressing toner consumption caused by toner shifting from the developing roller 54 to the photoconductive drum 121, the supply roller 53 and the developing roller 54 each make at least one rotation upon ending of the image formation. At this point, as is the case with the developing roller 54 and the supply roller 53, the first spiral feeder 51 and the second spiral feeder 52 each make at least one rotation.

The toner concentration detection section 56 has a detection surface 56A exposed in the housing 58, and detects toner concentration in the housing 58. The detection surface 56A is embedded in a hole formed at an inner wall of the housing 58 opposing the stirring plate 57. The toner concentration detection section 56 is composed of, for example, a magnetic detector detecting a change in magnetic permeability in the developer, and detects this change in the magnetic permeability as the toner concentration. Note that the toner concentration detection section 56 may be composed of, for example, an optical detector detecting reflective light of the developer.

As shown in FIG. 3, the stirring plate 57 extends in a direction along a rotary shaft 51A of the first spiral feeder 51 and a radial direction orthogonal to the direction along the rotary shaft 51A, and is attached to the rotary shaft 51A of the first spiral feeder 51 in a manner such as to be rotatable together with this rotary shaft 51A. As shown in FIG. 2, the stirring plate 57 has a tip part 57T located in this radial direction at a predefined distance from the detection surface 56A. The stirring plate 57 rotates together with the first spiral feeder 51 and stirs the developer stored in the housing 58.

The elastic member 59 is formed by using an elastic material such as synthetic leather, rubber, or sponge. As shown in FIG. 2, the elastic member 59 is attached to the stirring plate 57 in such a manner as to surround a one-side surface 57A and an another-side surface 57B in a rotation direction of the stirring plate 57 and the tip part 57T in the radial direction of the stirring plate 57, has a sufficient length in the radial direction (the direction orthogonal to the direction of the rotary shaft 51A) enough to abut the detection surface 56A, and makes sliding-contact with the detection surface 56A while rotating together with the stirring plate 57. Formed at the elastic member 59 is a notch part 59A into which the tip part 57T of the stirring plate 57 can be inserted. The tip part 57T of the stirring plate 57 is inserted into the notch part 59A whereby the elastic member 59 is attached to the stirring plate 57. The elastic member 59 can be fixed at the stirring plate 57 by use of, for example, bonding means such as a bonding agent or a double-faced tape, or a synthetic resin sheet such as a Lumilar sheet.

Figure 4:
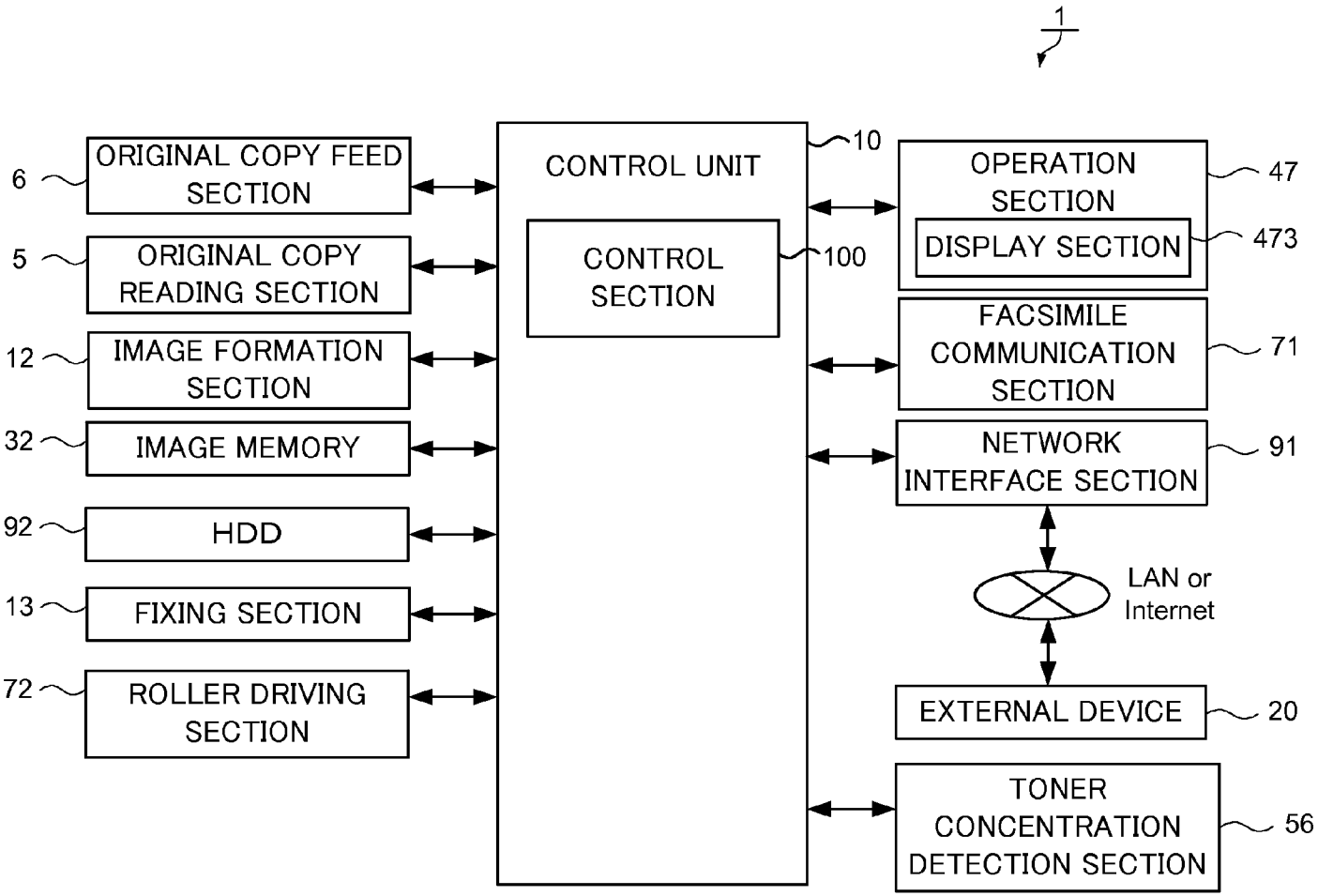
FIG. 4 is a functional block diagram showing main inner configuration of the image forming apparatus.

FIG. 4 is a functional block diagram showing main inner configuration of the image forming apparatus 1. The image forming apparatus 1 includes: a control unit 10, the original copy feed section 6, the original copy reading section 5, the image formation section 12, an image memory 32, an HDD 92, the fixing section 13, the operation section 47, a facsimile communication section 71, the roller driving section 72, a network interface section 91, the toner concentration detection section 56, etc. Note that the same components as those described with reference to FIG. 1 are provided with the same numerals and thus omitted from the description.

The original copy reading section 5 includes a reading mechanism 163 (FIG. 1) having, for example, a light irradiation section and a CCD sensor under control by the control section 100 included in the control unit 10. The original copy reading section 5 irradiates an original copy by the light irradiation section and receives its reflective light with the CCD sensor to thereby read an image from the original copy.

The image memory 32 is a region temporarily storing data of the image of the original copy acquired through the reading by the original copy reading section 5 and temporarily saving data targeted for printing by the image formation section 12.

The HDD 92 is a large-capacity storage device which stores, for example, the image of the original copy read by the original copy reading section 5.

The facsimile communication section 71 includes an encoding-decoding section, a modulation and demodulation section, and a network control unit (NCU), all not shown, and performs facsimile transmission by use of a public telephone network.

The roller driving section 72 is composed of a motor, a gear, a driver, etc., and plays a role as a driving source that provides a rotational driving force to the supply roller 53, the developing roller 54, the first spiral feeder 51, and the second spiral feeder 52. The roller driving section 72 is one example of a rotational driving section in the scope of the claims.

The network interface section 91 is composed of a communication module such as a LAN board, and performs transmission and reception of various pieces of data to and from an external device 20 such as a personal computer in a local area or on the Internet via, for example, the LAN connected to the network interface section 91.

The control unit 10 is composed of a central processing unit (CPU), a RAM, a ROM, a dedicated hardware circuit, etc. The control unit 10 includes the control section 100. The control section 100 is in charge of overall operation control.

The control section 100 is connected to the control unit 10, the original copy feed section 6, the original copy reading section 5, the image formation section 12, the image memory 32, the HDD 92, the fixing section 13, the operation section 47, the facsimile communication section 71, the roller driving section 72, the network interface section 91, the toner concentration detection section 56, etc., and controls these sections.

At time of image formation, the control section 100 drives the roller driving section 72 to make the first spiral feeder 51 and the second spiral feeder 52 positively rotate in directions of arrows F1 and F2, respectively, in FIG. 2. Upon ending of this image formation processing, the control section 100 drives the roller driving section 72 to make the first spiral feeder 51 and the second spiral feeder 52 inversely rotate at least once in directions opposite to the directions of the arrows F1 and F2, respectively, in FIG. 2.

The control unit 10 functions as the control section 100 through an operation in accordance with an image processing program. Note that, however, this control section 100 can be formed by a hardware circuit without depending on the operation in accordance with the image processing program by the control unit 10. Hereinafter, the same applies to each of the embodiments unless otherwise specified.

Figure 5:
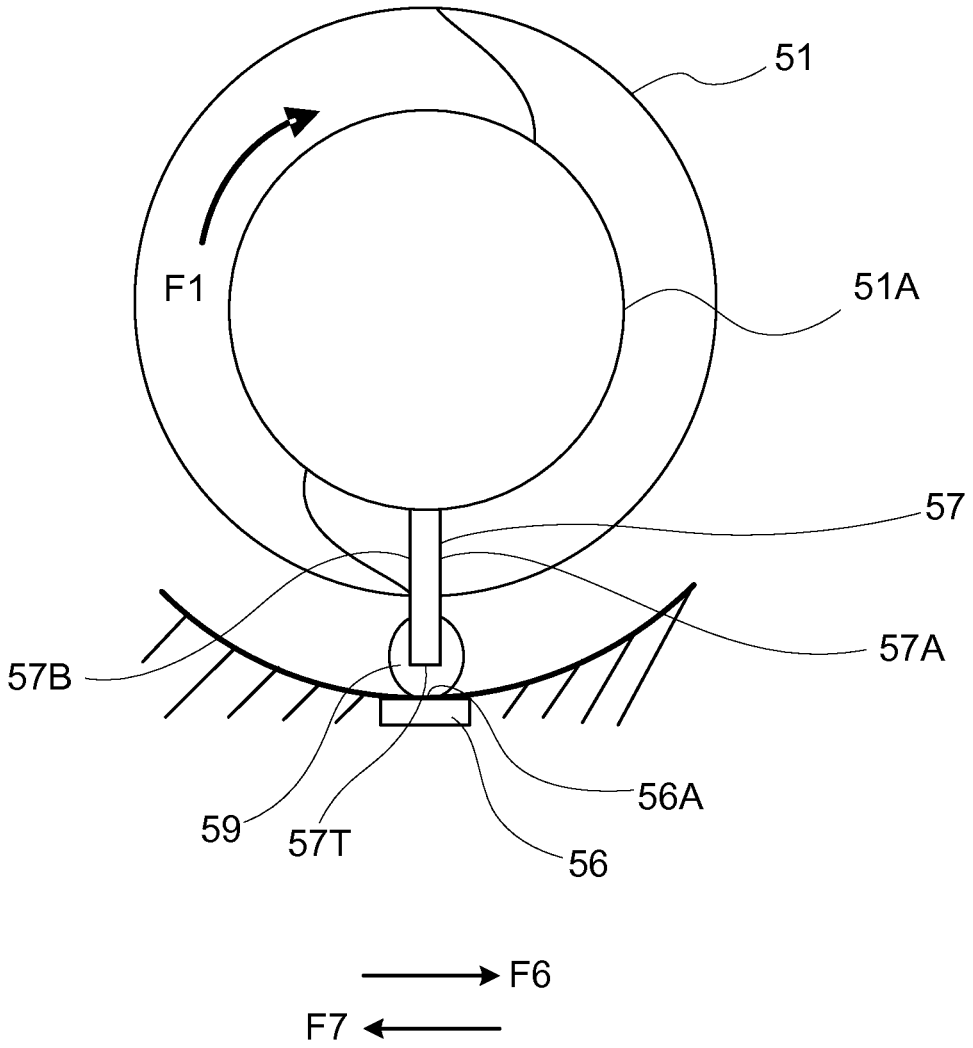
FIG. 5 is a sectional view showing a structure of an elastic member shown in FIG. 3 and also according to the first embodiment of this disclosure.

FIG. 5 is a sectional view showing a structure of the elastic member shown in FIG. 3 and also according to the first embodiment of this disclosure. As shown in FIG. 5, in this embodiment, the stirring plate 57 is attached to the rotary shaft 51A of the first spiral feeder 51 in a manner such as to be rotatable together with the rotary shaft 51A, and has the tip part 57T located in the radial direction at the predefined distance from the detection surface 56A. The elastic member 59 is attached to the stirring plate 57 in such a manner as to surround the one-side surface 57A and the another-side surface 57B in the rotation direction of the stirring plate 57 and the tip part 57T in the radial direction of the stirring plate 57, has a sufficient length in the radial direction (direction orthogonal to the direction of the rotary shaft 51A) enough to abut the detection surface 56A, and makes sliding-contact with the detection surface 56A while rotating together with the stirring plate 57. In a case where the first spiral feeder 51 and the stirring plate 57 rotate in a direction of an arrow F1, a force acts on a portion of the elastic member 59 on the another-side surface 57B side in such a manner as not to separate it from the another-side surface 57B (in a direction of an arrow F6 in FIG. 5), and thus even if a force acts on a portion of the elastic member 59 on the one-side surface 57A in such a manner as to separate it from the one-side surface 57A (in the direction of the arrow F6 in FIG. 5), the elastic member 59 as a whole does not separate from the stirring plate 57.

On the other hand, in a case where the first spiral feeder 51 and the stirring plate 57 rotate in a direction opposite to the arrow F1 in FIG. 5, a force acts on the portion of the elastic member 59 on the one-side surface 57A side in such a manner as not to separate it from the one-side surface 57A (in the direction of the arrow F7 in FIG. 5), and thus even if a force acts on the portion of the elastic member 59 on the another-side surface 57B in such a manner as to separate it from the another-side surface 57B (in the direction of the arrow F7 in FIG. 5), the elastic member 59 as a whole does not separate from the stirring plate 57.

Figure 6A:
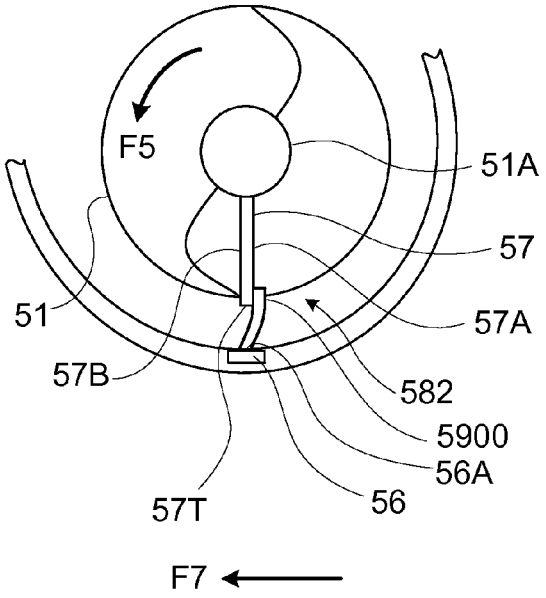
Fig.6A Related Art
FIG. 6A and FIG. 6B are views illustrating a typical elastic member as a comparative example of this disclosure.
Figure 6B:
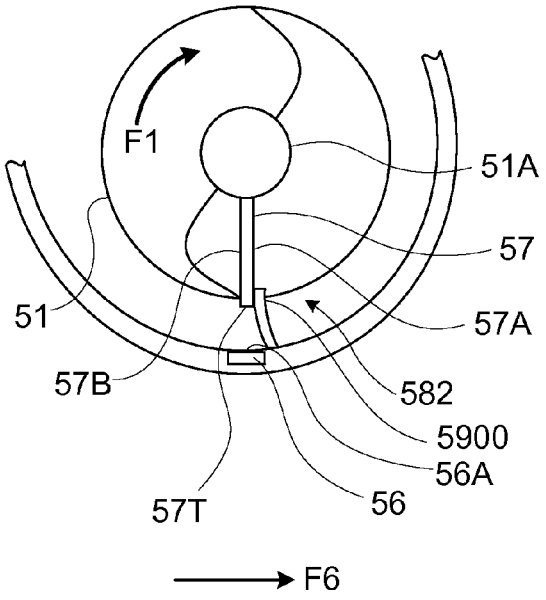
Fig.6B Related Art

FIGS. 6A and 6B are views illustrating a typical elastic member 5900 as a comparative example of this disclosure. FIG. 6A is an illustrative view showing a state in which the first spiral feeder 51 and the stirring plate 57 are rotated in a direction of an arrow F5. As shown in FIG. 6B, the elastic member 5900 was attached to only the one-side surface 57A side of the stirring plate 57. In a case where the first spiral feeder 51 and the stirring plate 57 rotate in the direction of the arrow F5, a direction in which a force works on the elastic member 5900 is a direction in which it makes some inroads into the one-side surface 57A (a direction of an arrow F7 in FIG. 6A), and thus there was no risk of separation of the elastic member 5900 from the stirring plate 57.

FIG. 6B is an illustrative view showing a state in which the first spiral feeder 51 and the stirring plate 57 are rotated in a direction of an arrow F1. In a case where the first spiral feeder 51 and the stirring plate 57 rotate in the direction of the arrow F1, a direction in which a force works on the elastic member 5900 is a direction in which it separates from the one-side surface 57A of the stirring plate 57 (a direction of an arrow 6 in FIG. 6B), and thus there was a risk of the separation of the elastic member 5900 from the stirring plate 57.

On the contrary, in this embodiment, the elastic member 59 is attached to both the one-side surface 57A and the another-side surface 57B in the rotation direction of the stirring plate 57, and thus in a case where the first spiral feeder 51 and the stirring plate 57 rotate in the direction of the arrow F1 as shown in FIG. 5, a force works on the portion of the elastic member 59 on the another-side surface 57B in such a manner as not to separate it from the another-side surface 57B (the direction of the arrow F6 in FIG. 5), and thus even if a force works on the portion of the elastic member 59 on the one-side surface 57A in such a manner as to separate it from the one-side surface 57A (the direction of the arrow F6 in FIG. 5), the elastic member 59 as a whole does not separate from the stirring plate 57. Therefore, in this embodiment, the elastic member 59 can be more firmly attached to the stirring plate 57.

In other words, in this embodiment, even upon rotation of the first spiral feeder 51 and the stirring plate 57 in any direction around its rotary shaft, the separation of the elastic member 59 from the stirring plate 57 can be prevented.

Next, the developing device and the image forming apparatus according to the second embodiment of this disclosure will be described with reference to the drawings. Same components as those of the developing device 122 and the image forming apparatus 1 described in the first embodiment will be omitted from the description.

Figure 7A:
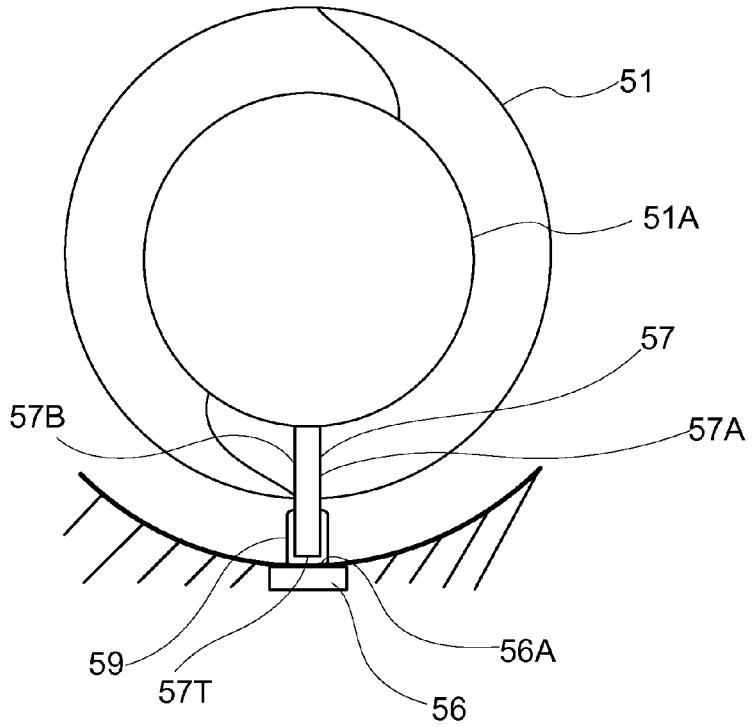
FIG. 7A is a sectional view showing a structure of an elastic member according to a second embodiment of this disclosure.

FIG. 7A is a sectional view showing a structure of an elastic member 59 according to the second embodiment of this disclosure. As shown in this figure, in this embodiment, a shape of the elastic member 59 is different from that of the first embodiment. The elastic member blade 59 is formed of one sheet-type elastic body. The elastic member 59 is attached to the stirring plate 57 by being wound around a one-side surface 57A, an another-side surface 57B, and a tip part 57T.

In this embodiment, since the elastic member 59 is formed of the one sheet-type elastic body, the elastic member 59 can be attached to the stirring plate 57 only by winding it around the one-side surface 57A, the another-side surface 57B, and the tip part 57T of the stirring plate 57, thus improving assemblability.

Next, the developing device and the image forming apparatus according to the third embodiment of this disclosure will be described with reference to the drawings. Same components as those of the developing device 122 and the image forming apparatus 1 described in the first embodiment will be omitted from the description.

Figure 7B:
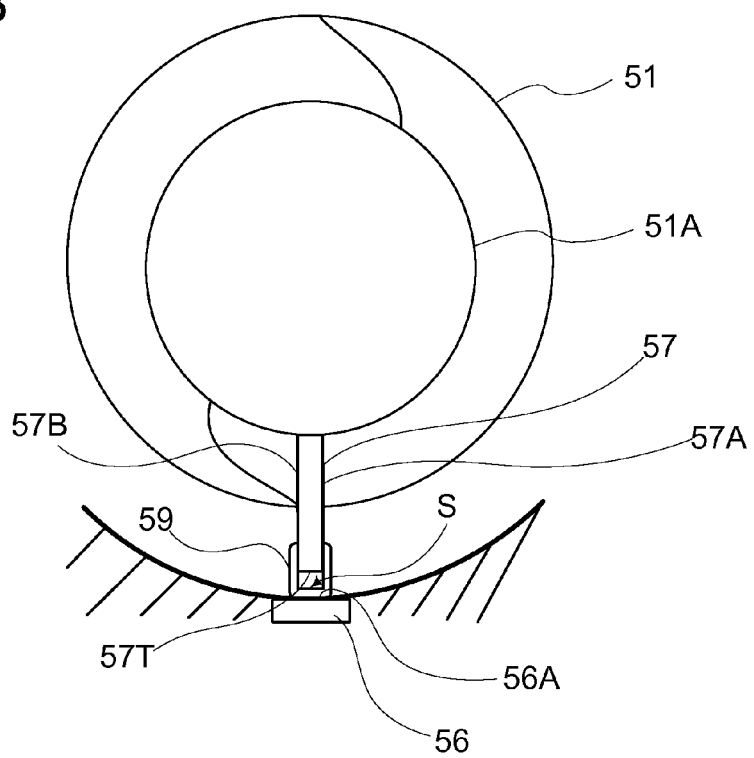
FIG. 7B is a sectional view showing a structure of an elastic member according to a third embodiment of this disclosure.

FIG. 7B is a sectional view showing a structure of an elastic member 59 according to the third embodiment of this disclosure. As shown in this figure, in this embodiment, a shape of the elastic member 59 is different from that of the first embodiment. The elastic member 59 is formed of one sheet-type elastic body. The elastic member 59 is attached to a stirring plate 57 by winding this elastic body around a one-side surface 57A, an another-side surface 57B, and a tip part 57T. Formed between the tip part 57T and an inner surface of the elastic member 59 opposing this tip part 57T is a space S having a predefined length in a radial direction orthogonal to a direction of a rotary shaft 51A.

In this embodiment, in addition to the attachment of the elastic member 59 to the stirring plate 57 by winding the elastic body around the one-side surface 57A, the another-side surface 57B, and the stirring plate 57, the space S is formed between the tip part 57T and the inner surface of the elastic member 59. Load imposed on a detection surface 56A upon abutting of the elastic member 59 against the detection surface 56A is absorbed in the space S and is thereby reduced, thus reducing a force working on the detection surface 56A.

Moreover, as a result of the formation of the space S, a degree of freedom in positional relationship between the detection surface 56A and the elastic member 59 increases.

Next, the developing device and the image forming apparatus according to the fourth embodiment of this disclosure will be described with reference to the drawings Same components as those of the developing device 122 and the image forming apparatus 1 described in the first embodiment will be omitted from the description.

Figure 8:
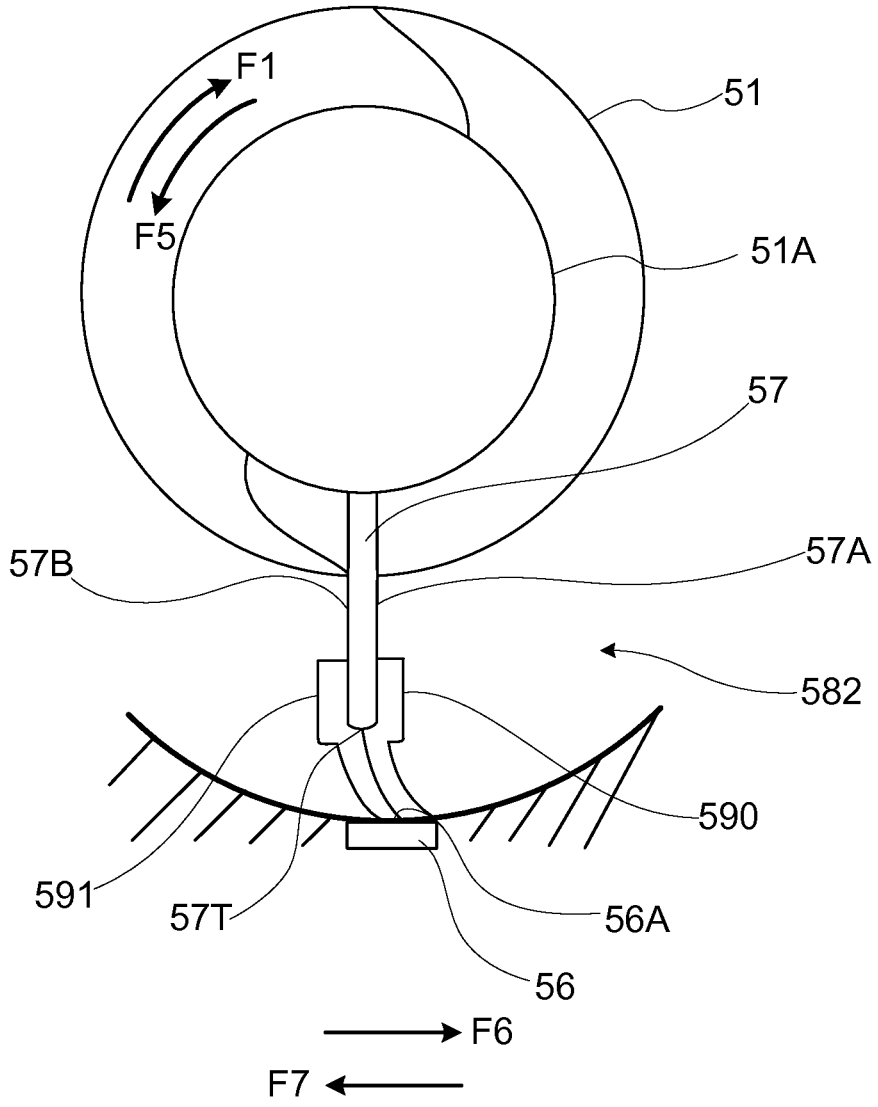
FIG. 8 is a sectional view showing a structure of an elastic member according to a fourth embodiment of this disclosure.

FIG. 8 is a sectional view showing a structure of an elastic member 59 according to the fourth embodiment of this disclosure. In this embodiment, a shape of the elastic member 59 is different from that of the first embodiment. The elastic member 59 has: a first elastic body 590 and a second elastic body 591. In this embodiment, elasticity of the first elastic body 590 is equal to elasticity of the second elastic body 591. The elastic member 59 is attached to a tip part 57T by sandwiching a one-side surface 57A, an another-side surface 57B, and the tip part 57T with the first elastic body 590 and the second elastic body 591 from both sides in a rotation direction of a stirring plate 57 and then integrating them together. The first elastic body 590 and the second elastic body 591 have a sufficient length in a radial direction enough to abut, in a bent state, a detection surface 56A, and makes sliding-contact with the detection surface 56A while rotating together with the stirring plate 57.

In this embodiment, in a case where a first spiral feeder 51 and the stirring plate 57 rotate in a direction of an arrow F1 in FIG. 8, a force acts on the second elastic body 591 in such a direction as not to separate it from the another-side surface 57B (a direction of an arrow F6 in FIG. 8), and thus even if a force works on the first elastic body 590 in such a direction as to separate it from the one-side surface 57A, the elastic member 59 as a whole does not separate from the stirring plate 57.

On the other hand, in a case where the first spiral feeder 51 and the stirring plate 57 rotate in a direction of an arrow F5 in FIG. 8, a force acts on the first elastic body 590 in such a direction as not to separate it from the one-side surface 57A (a direction of an arrow F7 in FIG. 8), and thus even if a force acts on the second elastic body 591 in such a direction as to separate it from the another-side surface 57B (the direction of the arrow F7), the elastic member 59 as a whole does not separate from the stirring plate 57.

Further, in a case where the first spiral feeder 51 and the stirring plate 57 rotate in a constant direction, a degree of elasticity of the elastic body at a rotation direction leading side may be greater than a degree of elasticity of the elastic body at a rotation direction trailing side. For example, in a case where the first spiral feeder 51 and the stirring plate 57 rotate in the direction of the arrow F1 in FIG. 8, a degree of elasticity of the second elastic body 591 may be greater than a degree of elasticity of the first elastic body 590. In this case, a force works on the first elastic body 590 in such a direction as to separate it from the one-side surface 57A a (direction of an arrow F6). At this point, the second elastic body 591 is located in a rotation direction leading side and has a great amount of deflection, but is soft with the greater degree of elasticity than that of the first elastic body 590, and thus more easily absorbs load caused by this deflection. Moreover, the second elastic body 591 is more easily bent than the first elastic body 590 which is located in a rotation direction trailing side, and is further bent instead of the first elastic body 590 to absorb the load, which therefore reduces press load imposed on the first elastic body 590 caused by this deflection. As a result, the first elastic body 590 hardly separates from the one-side surface 57A.

The configuration and processing shown in the embodiments described above with reference to FIGS. 1 to 8 are each just one embodiment of this disclosure, and thus the configuration and processing of this disclosure are not limited thereto.

Various modifications and alterations of this disclosure will be apparent to those skilled in the art without departing from the scope and spirit of this disclosure, and it should be understood that this disclosure is not limited to the illustrative embodiments set forth herein.

What is claimed is:

1. A developing device comprising:

a container storing developer;

a stirring member stirring the developer stored in the container while making rotation;

a developing roller supplying the developer to a photoconductor;

a toner concentration detection section having a detection surface exposed inside of the container and detecting concentration of a toner in the container;

a stirring plate extending in a direction along a rotary shaft of the stirring member and a radial direction orthogonal to the direction along the rotary shaft, being attached to the rotary shaft of the stirring member in a manner such as to be rotatable together with the rotary shaft, and having a tip part located in the radial direction at a predefined distance from the detection surface; and an elastic member having elasticity, being attached to the stirring plate in a manner such as to surround a one-side surface, an another-side surface, and the tip part in a rotation direction of the stirring plate, having a sufficient length in the radial direction enough to abut the detection surface, and making sliding-contact with the detection surface while rotating together with the stirring plate, wherein the elastic member is formed of a sheet-type elastic body, the elastic member is attached to the stirring plate by winding the elastic body around the one-side surface, the another-side surface, and the tip part, and a space having a predefined length in the radial direction is formed between the tip part and an inner surface of the elastic member opposing the tip part.

2. A developing device comprising:

a container storing developer;

a stirring member stirring the developer stored in the container while making rotation;

a developing roller supplying the developer to a photoconductor;

a toner concentration detection section having a detection surface exposed inside of the container and detecting concentration of a toner in the container;

a stirring plate extending in a direction along a rotary shaft of the stirring member and a radial direction orthogonal to the direction along the rotary shaft, being attached to the rotary shaft of the stirring member in a manner such as to be rotatable together with the rotary shaft, and having a tip part located in the radial direction at a predefined distance from the detection surface; and an elastic member having elasticity, being attached to the stirring plate in a manner such as to surround a one-side surface, an another-side surface, and the tip part in a rotation direction of the stirring plate, having a sufficient length in the radial direction enough to abut the detection surface, and making sliding-contact with the detection surface while rotating together with the stirring plate, wherein the elastic member has a first elastic body and a second elastic body, and is attached to the tip part by sandwiching the first elastic body and the second elastic body from both sides in the rotation direction of the stirring plate with the one-side surface, the another-side surface, and the tip part of the stirring plate to thereby integrate them together.

3. The developing device according to claim 2, wherein the second elastic body is provided on a side surface of the stirring plate located in a rotation direction leading side of the stirring plate, the first elastic body is provided on the another-side surface of the stirring plate located in a rotation direction trailing side of the stirring plate, and a degree of elasticity of the second elastic body is greater than a degree of elasticity of the first elastic body.

* * * * *